United States Patent [19]

Hayashi et al.

[11] 4,033,308

[45] July 5, 1977

[54] EXHAUST GAS RECIRCULATION CONTROL SYSTEM

[75] Inventors: Yoshimasa Hayashi, Yokohama; Yasuo Nakajima, Yokosuka; Kunihiko Sugihara; Syunichi Aoyama, both of Yokohama, all of Japan

[73] Assignee: Nissan Motor Co., Ltd., Japan

[22] Filed: June 19, 1975

[21] Appl. No.: 588,237

[30] Foreign Application Priority Data

June 24, 1974 Japan ..... 49-72082

[52] U.S. Cl. ..... 123/119 A
[51] Int. Cl.² ..... F02M 25/06
[58] Field of Search ..... 123/119 A

[56] References Cited

UNITED STATES PATENTS

| | | | |
|---|---|---|---|
| 3,739,797 | 6/1973 | Caldwell | 123/119 A |
| 3,774,583 | 11/1973 | King | 123/119 A |
| 3,796,049 | 3/1974 | Hayashi | 123/119 A |
| 3,814,070 | 6/1974 | Wertheimer | 123/119 A |
| 3,818,880 | 6/1974 | Dawson et al. | 123/119 A |
| 3,877,452 | 4/1975 | Nohira et al. | 123/119 A |
| 3,915,136 | 10/1975 | Caldwell | 123/119 A |
| 3,924,589 | 12/1975 | Nohira et al. | 123/119 A |
| 3,926,161 | 12/1975 | Wertheimer | 123/119 A |

*Primary Examiner*—C. J. Husar
*Assistant Examiner*—David D. Reynolds
*Attorney, Agent, or Firm*—Robert E. Burns; Emmanuel J. Lobato; Bruce L. Adams

[57] ABSTRACT

Gas recirculation into engine combustion chambers is controlled to a constant ratio with respect to the amount of induction air despite wide variations in manifold vacuum.

12 Claims, 2 Drawing Figures

EXHAUST GAS RECIRCULATION CONTROL SYSTEM

BACKGROUND OF THE INVENTION

This invention relates to a device for controlling exhaust gas recirculation (EGR), particularly as applied to motor vehicles driven by internal combustion engines.

The circulation of portions of internal combustion engine exhaust back to the engine combustion chambers is coming into general use for suppressing to some extent the formation of NOx in the engine exhaust, the idea being to introduce inert substances, i.e., combusted exhaust gas into the combustion chamber in order to lower peak combustion temperatures therein, thereby reducing NOx formation. An EGR valve is used to control recirculation of the exhaust gas. The valve is typically a vacuum operated valve.

This invention is particularly directed to "amplifier" EGR systems, as opposed to "ported" EGR systems. Amplifier system are distinguished from ported systems in that the former utilize a vacuum amplifier controlled by venturi vacuum for providing controlled modulated vacuum to an EGR valve. In the ported systems the vacuum to the EGR valve is modulated by the throttle valve at a port in the engine carburetor bore. Amplifier EGR system has heretofore tended to have limited capacility for controlling NOx emissions. Specifically, manifold vacuum tends to vary widely depending on engine operation thus effecting the control of the EGR valve. Even if the level of the venturi vacuum is constant or the amount of induction air is constant, the amount of the exhaust gas recirculated to combustion chambers changes with respect to manifold vacuum, in other words, the amount of same is considerably larger when the manifold vacuum is at a considerably high level, for example, during low engine loads or decelerations as compared with when the manifold vacuum is at a considerably low level, for example, during high engine load operations. This variation of the amount of recirculated gas with respect to the amount of induction air invites unstable engine operations.

SUMMARY OF THE INVENTION

It is, therefore, a prime object of the present invention to provide an improved exhaust gas recirculation control system capable to overcoming problems of the prior art.

It is another object of the present invention to provide an improved exhaust gas recirculation control system by which the amount of exhaust gas recirculated into the combustion chambers is controlled to a constant ratio with respect to the amount of induction air although the intake vacuum varies widely.

It is a further object of the present invention to provide compensating means to modify the input vacuum or venturi vacuum in the exhaust gas recirculation control system in accordance with an intake vacuum produced in an induction passage located downstream of the throttle valve of a carburetor.

Other objects and features of the improved exhaust gas recirculation control system according to the present invention will be more apparent from the following description taken in conjunction with the accompanying drawings in which:

DESCRIPTION OF THE PREFERRED EMBODIMENTS

Figure 1:
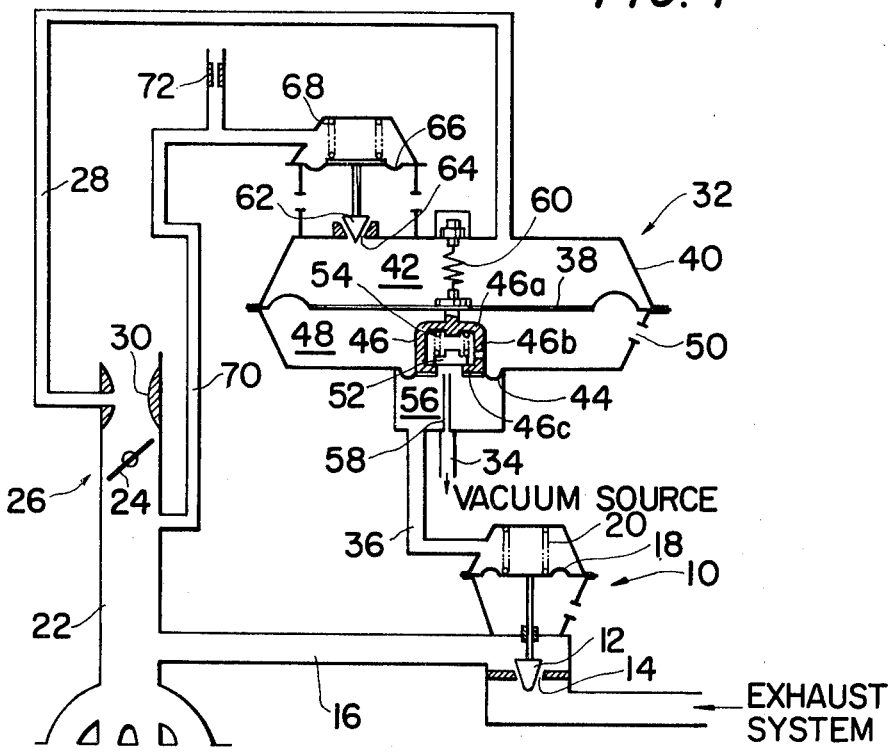
FIG. 1 represents a schematic diagram of an exhaust gas recirculation control system incorporating a preferred form of compensating means of the present invention.

The invention can be best be understood by referring to the schematic of FIG. 1 which shows an improved EGR control system and apparatus for motor vehicles driven by internal combustion engines in which according to this invention exhaust gas is recirculated to the engine combustion chambers to lower exhaust gas emissions of NOx. The figure includes an exhaust gas recirculation valve 10 capable of controllably recirculating exhaust gases. The valve 10 has a valve member 12 which is arranged to open and close the restriction opening 14 of an exhaust gas recirculation passage 16. The valve member 12 is fixedly connected to a vacuum responsive diaphragm member 18 which is normally urged by a spring 20 in the direction to force the valve member 12 to close the opening 14. The exhaust gas recirculation passage 16 interconnects an exhaust system (not shown) and a portion of an induction passage 22 located downstream of the throttle valve 24 of a carburetor 26. Carburetor venturi vacuum means is provided by a venturi vacuum conduit 28 which taps into the venturi section 30 of the carburetor 26 and thus senses the venturi vacuum.

A vacuum amplifier or control means, generally indicated at 32, interconnects the carburetor 26 and a vacuum source means such as a known vacuum reservoir container (not shown) by connection with the venturi vacuum conduit 28 and a source vacuum conduit 34 leading from the vacuum reservoir. The function of amplifier 32 is to provide a control output vacuum in a conduit 36 connected to the vacuum chamber (no numeral) of the EGR valve 10 for controlling the operation of the EGR valve 10. The control output vacuum is modulated by the venturi control vacuum applied to the amplifier 32 via conduit 28. Hence, the term "amplifier" is used since the input vacuum of the conduit 34 is transformed into a stronger vacuum of similar characteristics to the venturi vacuum of conduit 28. In short, the amplifier is means for providing a control output vacuum signal for the EGR valve 10 which is substantially proportional to the relatively weak venturi control signal vacuum.

The vacuum amplifier 32 includes first diaphragm means which is provided by a first diaphragm 38 disposed within a housing 40. The first diaphragm 38 defines an input vacuum chamber 42 between it and the upper portion of the housing 40. The input vacuum chamber 42 is communicated through the venturi vacuum conduit 28 with the venturi section of the carburetor 26. A second diaphragm 44 having at the central portion thereof an air bleed opening (no numeral), is disposed under the first diaphragm 38, to form part of second diaphragm means. The second diaphragm 44 is fixedly connected through a cup-shaped valve housing 46 to the central portion of the first diaphragm 38 and defines a medium chamber 48 between it and the first diaphragm 38. The medium chamber 48 is communicated with the atmosphere through an opening 50 of the housing 40. The cup-shaped valve housing 46 is formed with a closed end portion 46*a* attached to the central portion of the first diaphragm 38, a cylindrical wall portion 46*b* having an opening (no numeral) for communicating the inside of the valve housing 46 with the medium chamber 48, and an open end portion 46*c*. The open end portion 46*c* is provided with an inwardly-protruding flange portion (no numeral) which is fixed to the second diaphragm 44. The flange portion defines at the central portion thereof an opening (no numeral) which coincides with the air bleed opening of the second diaphragm 44. A valve member 52 is located within the valve housing 46 and is arranged to open and close the opening defined by the flange portion to open and close the air bleed opening of the second diaphragm 44. The valve member 52 is normally urged by a spring 54 located between the closed end portion 46*a* and the valve member 52 in such a direction that the valve member 52 sealingly contacts the inner surface of the inwardly protruding flange portion of the valve housing 46. The second diaphragm means defines an output vacuum chamber 56 between it and the lower portion of the housing 40. From the bottom of the output vacuum chamber 56, a vacuum pipe 58 upwardly extends and has an open end thereof which is contactable with the flat surface of the valve member 52. The vacuum pipe 58 is connected to the source vacuum conduit 34 which communicates with the vacuum source means. The output vacuum chamber 56 is communicated through the conduit 36 with the diaphragm member 18 of the EGR valve 10. Within the input vacuum chamber 42, a spring 60 is disposed between the upper portion of the housing 40 and the first diaphragm 38 to bias the first diaphragm 38 in such a direction that the volume of the input vacuum chamber 42 decreases.

Compensating means includes a valve member 62 which is arranged to open and close an air bleed opening 64 formed through the upper portion of the housing 40 of the amplifier 32. The valve member 62 is fixedly connected to the diaphragm member 66 which is normally urged by a spring 68 in a direction to cause the valve member 62 to close the air bleed opening 64. The diaphragm member 66 is arranged to communicate through an intake vacuum conduit 70 with the induction passage 22 which is located downstream of the throttle valve 24 of the carburetor 26. The intake vacuum conduit 70 branches off and has an air bleed orifice 72 therein. The compensating means functions to proportionally decrease the venturi vacuum supplied into the input vacuum chamber 42 in accordance with the increase of the intake vacuum within the induction passage 22 by bleeding air through the air bleed opening 64 of the amplifier housing 40.

With the arrangement described hereinbefore, when the venturi vacuum or carburetor venturi vacuum control signal is introduced into the input vacuum chamber 42 and acts on the first diaphragm 38, the first diaphragm 38 is moved upwardly and therefore the valve member 52 of the second diaghragm means lifts to open the end of the vacuum pipe 58 leading from the vacuum source. Then, vacuum from the vacuum source acts on the diaphragm member 18 of the EGR valve 10 to allow the exhaust gases to flow from the exhaust system into the induction passage 22. When the vacuum level within the output vacuum chamber 56 gradually increases and acts on the second diaphragm 44 to pull same downwardly, the valve member 52 of the second diaphragm means is also moved downwardly and closes off the open end of the vacuum pipe 58. In this state, equilibrium is established between the force exerted on the first diaphragm means and the force exerted on the second diaphragm means. The equilibrium condition is expressed by the following equation:

$$A \cdot Vv + Fo - a\,Vs = O \ldots \quad (1)$$

accordingly, $$Vs = A/a \cdot Vv + Fo/a \ldots \quad (2)$$

where Vv is an input vacuum (venturi vacuum) in the input vacuum chamber 42, Vs is an output vacuum in the output vacuum chamber 56, A is an effective area of the first diaphragm 38, a is an effective area of the second diaphragm 44, and Fo is an initial biasing force of the spring 60. It will be seen from the above equation that the output vacuum Vs is approximately A/*a* times the input vacuum (venturi vacuum) and therefore the output vacuum in the output vacuum chamber 56 is an amplification of the input vacuum (venturi vacuum) in the input vacuum chamber 42 multified by the ratio of the effective areas of these two diaphragms 38, 44 or A/*a*.

The output vacuum, thus amplified, in the output vacuum chamber 56 acts on the diaphragm member 18 of the EGR valve 10 through the conduit 36 and causes the valve member 12 to proportionally open the restriction opening 14 in accordance with the input vacuum in the input vacuum chamber 42.

When the input vacuum in the input vacuum chamber 42 decreases below the level of above equilibrium condition, the balance between forces exerted on the first and second diaphragm means is disturbed and therefore the second diaphragm 44 is moved downwardly in the direction of the output vacuum chamber 56. Accordingly, the valve member 52 of the second diaphragm means is pushed up and therefore the opening located beneath the valve member 52 is allowed to open. Then, atmospheric air in the medium chamber 48 bleeds into the output vacuum chamber 56 through the opening of the cylindrical wall portion 46*b* and the opening beneath the valve member 52. When the vacuum level in the output vacuum chamber 56 begins to decrease and the force exerted on the second diaphragm means decreases below the force exerted on the first diaphragm means, the second diaphragm 44 is again pulled upwardly by the first diaphragm 38 and the valve member 52 closes the opening of the second diaphragm 44 (at this time, vacuum pipe 58 is closed). In this state, the equiblirium is again established to balance the forces exerted on the first and second diaphragm means.

It will be seen that even if the level of the input vacuum (the venturi vacuum) is so low as to approach atmospheric pressure, the vacuum amplifier 32 can begin operation since the biasing force Fo of the spring 60 acts on the first diaphragm 38 to move the first diaphragm 38 in the direction to decrease the volume of the input vacuum chamber 42.

As apparent from the above, the degree of opening of the EGR valve 10 is thus regulated to control the exhaust gas recirculation in accordance with the venturi vacuum of the carburetor 26. However, it should be noted that the amount of exhaust gas recirculated changes in accordance with the pressure differential between portions upstream and downstream of the EGR valve 10, in addition to the venturi vacuum. In other words, even if the venturi vacuum is constant or the amount of induction air is constant, the amount of exhaust gas recirculated changes in accordance with intake vacuums produced at a downstream portion of the throttle valve 24 of the carburetor 26.

In view of the above fact, the compensating means is provided in accordance with the present invention and is operated as follows: when the intake vacuum in the induction passage 22 gradually increase, the intake vacuum acts on the diaphragm member 66 to move it upwardly and therefore valve member 62 is lifted. Accordingly, the air bleed opening 64 formed through the vacuum amplifier housing 40 is caused to open proportionally in accordance with the magnitude of the intake vacuum produced in the induction passage 22. Then, atmospheric air bleeds into the input vacuum chamber 42 through the opening 64 to decrease the level of the venturi vacuum in the input chamber 42. It will be understood that the compensating means controls the amount of the exhaust gas recirculation to a constant ratio with respect to the amount of induction air although the intake vacuum varies widely.

Figure 2:
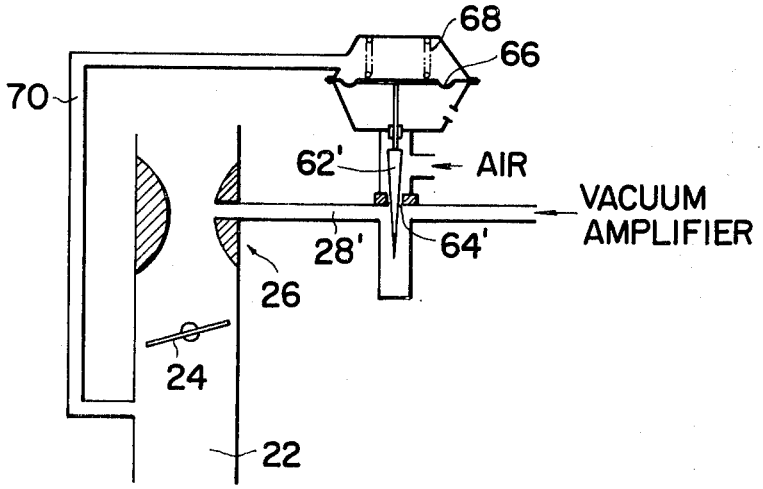
FIG. 2 is a schematic diagram showing another preferred form of the compensating means.

FIG. 2 illustrates another example of the compensating means according to the present invention which is similar to that shown in FIG. 1 except that the compensating means of this example incorporates a venturi conduit 28'. In this figure, the venturi vacuum conduit 28' connects the venturi section 30 of the carburetor 26 and the input vacuum chamber (not shown) and is provided with an air bleed opening 64' through which atmospheric air is bled into the venturi vacuum conduit 28'. A needle valve member 62' is arranged to open and close the air bleed opening 64'. The valve member 62' is fixedly connected to the diaphragm member 66 and normally urged downwardly by the spring 68' to close the air bleed opening 64'. The diaphragm member 66' is arranged to communicate with the induction passage 22 which is located downstream of the throttle valve 24 of the carburetor 26.

With this arrangement, when the intake vacuum in the induction passage 22 increases, the venturi vacuum or the input vacuum is decreased and therefore the amount of the exhaust gas recirculated is controlled to the constant ratio with respect to the amount of the induction air.

The output vacuum Vs obtained by the system provided with the compensating means according to the present invention is expressed by the following equation:

$$Vs = A/a \cdot G(Vv \cdot Vm) + Fo/a \ldots \quad (3)$$

Where $Vm$ is an intake vacuum in the induction passage 22. It will be understood from the above equation that the output vacuum $Vs$ is a function of the input vacuum (venturi vacuum) $Vv$ and the intake vacuum $Vm$.

What is claimed is:

1. An exhaust gas recirculation control system for a motor vehicle driven by an internal combustion engine whereby exhaust gas is recirculated to the engine combustion chambers to lower exhaust gas emission of NOx, the system comprising:

a vacuum operated exhaust gas recirculation control valve;

vacuum source means for providing an operating control vacuum to said exhaust gas recirculation control valve during engine operation;

carburetor venturi vacuum means for providing a carburetor venturi vacuum control signal during engine operation;

control means responsive to the venturi vacuum control signal and for modulating, in accordance with the venturi vacuum control signal, the operating control vacuum provided to the exhaust gas recirculation control valve by said vacuum source; and compensating means for venting said venturi vacuum means in accordance with an engine intake vacuum signal generated downstream of the throttle valve of the carburetor, which signal is provided by engine intake vacuum source means, thereby decreasing the magnitude of the venturi vacuum control signal in proportion to the magnitude of the engine intake vacuum signal generated downstream of the throttle valve.

2. An exhaust gas recirculation system as claimed in claim 1, in which said control means includes a housing, first diaphragm means disposed within said housing for defining an input vacuum chamber between it and the upper portion of said housing, and second diaphragm means disposed within said housing diaphragm for defing a medium chamber between said first and second diaphragm means and for further defining an output vacuum chamber between said second diaphragm means and a lower portion of said housing.

3. An exhaust gas recirculation system as claimed in claim 2, in which said vacuum source means includes a vacuum pipe which extends into the output vacuum chamber and in communication with a vacuum source, the open end of said vacuum pipe being disposed to be selectively opened by said second diaphragm means.

4. An exhaust gas recirculation system as claimed in claim 3, in which said carburetor venturi vacuum means includes a venturi vacuum conduit which taps into the venturi section of a carburetor, said venturi vacuum conduit communicating with the input vacuum chamber of said control means.

5. An exhaust gas recirculation system as claimed in claim 4, in which said exhaust gas recirculation valve includes a valve member to open and close an exhaust gas recirculation passage connected to an induction passage downstream of a throttle valve and an exhaust system of the engine, and a vacuum-responsive diaphragm member fixedly connected to said valve member, a spring normally urging said valve member in a direction in which said valve member closes the exhaust gas recirculation passage, and said diaphragm member being arranged to communication with the output vacuum chamber of said control means.

6. An exhaust gas recirculation system as claimed in claim 4, in which said compensating means cooperates with the input vacuum chamber of said control means, said compensating means including a valve member to open and close an air bleed opening of said housing providing communication of the input vacuum chamber to atmosphere, a diaphragm member fixedly connected to said valve member, a spring normally urging said valve member in a direction in which said valve member closes the air bleed opening of said housing, said diaphragm member being arranged to communicate through an intake vacuum conduit with the induction passage downstream of the throttle valve.

7. An exhaust gas recirculation system as claimed in claim 6, in which said intake vacuum conduit is provided with an air bleed orifice for bleeding atmospheric air into the induction passage.

8. An exhaust gas recirculation system as claimed in claim 4, in which said compensating means is cooperative with said venturi vacuum conduit of said carburetor venturi vacuum means, said compensating means including a valve member to open and close an air bleed opening of said venturi vacuum conduit, a diaphragm member fixedly connected to said valve member, a spring normally urging the valve member in a direction in which said valve member closes the air bleed opening of said venturi vacuum conduit, and said diaphragm member communicating through an intake vacuum conduit with the induction passage downstream of the throttle valve.

9. An exhaust gas recirculation system as claimed in claim 2, in which said housing of said control means is provided with an opening for providing communication for the medium chamber with the atmosphere.

10. An exhaust gas recirculation system as claimed in claim 9, in which said second diaphragm means includes a diaphragm member having an air bleed opening communicable with atmospheric air through said opening of said housing, and a valve member to open and close said air bleed opening, a spring normally biasing said valve member in a direction in which said valve member closes said air bleed opening, said valve member being contactable with the open end of said vacuum pipe of said vacuum source means.

11. An exhaust gas recirculation system as claimed in claim 10, in which said second diaphragm means further include a cup-shaped valve housing having an opening providing communication for the inside of said valve housing with the medium chamber, a closed end portion fixedly attached to said first diaphragm means, and an open end portion having an inwardly-protruding flange portion, the flange portion being fixed to the diaphragm member of said second diaphragm means and defining at its central portion thereof an opening in registry with the air bleed opening of said diaphragm member of said second diaphragm means, said valve member of said second diaphragm means being located within said valve housing to open and close the opening defined by the flange portion, a spring located between the closed end portion of said valve housing and said valve member of said second diaphragm means urging said valve member in a direction in which said valve member of said second diaphragm means sealingly contacts with the inner surface of the flange portion to close the air bleed opening of said diaphragm member of said second diaphragm means.

12. An exhaust gas recirculation system as claimed in claim 2, in which said control means further includes a biasing spring located within the input vacuum chamber and connecting the upper inside portion of said housing and said first diaphragm means to bias said second diaphragm means into a direction in which the volume of the input vacuum chamber decreases.

* * * * *